US006022060A

United States Patent [19]

Early

[11] Patent Number: 6,022,060

[45] Date of Patent: Feb. 8, 2000

[54] LITTER RETRIEVAL DEVICE

[76] Inventor: Lawrence E. Early, 4098 Snapfinger Way, Decatur, Ga. 30035

[21] Appl. No.: 09/294,684

[22] Filed: Apr. 19, 1999

[51] Int. Cl.[7] ..... E01H 1/12

[52] U.S. Cl. ..... 294/61; 362/109

[58] Field of Search ..... 294/19.1, 24, 50, 294/50.5, 61; 43/5, 6; 30/151, 162, 164.5, 164.7; 135/65, 66, 77, 80–82, 910; 362/102, 109, 119, 120, 253

[56] References Cited

U.S. PATENT DOCUMENTS

| | | | |
|---|---|---|---|
| 2,642,306 | 6/1953 | Beeler | 294/61 |
| 3,181,031 | 4/1965 | Haberstick | 294/61 X |
| 4,183,570 | 1/1980 | Broyles et al. | 294/61 |
| 4,502,722 | 3/1985 | Rocquin | 294/61 |
| 4,856,835 | 8/1989 | Pacione | 294/61 |
| 5,003,437 | 3/1991 | Barrett | 294/19.1 X |
| 5,273,329 | 12/1993 | Wessel | 294/61 |
| 5,370,433 | 12/1994 | Yost | 294/50.5 |
| 5,642,911 | 7/1997 | Gatch | 294/61 |
| 5,685,586 | 11/1997 | Miller | 294/19.1 X |

*Primary Examiner*—Johnny D. Cherry
*Attorney, Agent, or Firm*—Joseph N. Breaux

[57] ABSTRACT

A device for retrieving litter items from the ground. The litter retrieval device eliminates the need for bending over to lift the litter items and includes a spike that could be used to pierce the item to be lifted. Because spikes can be dangerous if exposed all the time, the spike of the litter retrieval device of the present invention is retractable. In addition, because litter pickup is often best accomplished in the early morning hours before the heat of the day makes working outside undesirable, the litter retrieval device includes an illumination mechanism to provide illumination to the pointed tip area of the spike to allow the user to positively identify the litter item before it is pierced with the spike.

1 Claim, 1 Drawing Sheet

LITTER RETRIEVAL DEVICE

TECHNICAL FIELD

The present invention relates to litter retrieval mechanisms and more particularly to a litter retrieval device that includes a tubular body portion defining a connecting shaft passageway along the length thereof; a clear, resilient, diode cover and protector tip with a litter spike passageway formed entirely therethrough and into connection with a connecting shaft passageway; two high intensity output diodes encased within the diode cover and protector tip; an on/off switch in series electrical connection between a battery connector positioned within the tubular body portion and the two high intensity diodes; and a litter spike assembly having a handle attached to an elongated retraction shaft having a position locking pin extending radially therefrom that is slidably mounted in a locking pin shaft that is oriented in parallel with the connecting shaft passageway, and that is open at a handle end of the tubular body portion, a spike assembly including a rigid pointed spike having a pointed end slidably positionable within the spike passageway of the diode cover and protector tip and attached at a second spike end to a spike bushing slidably mounted within a spike slide passageway portion of the connecting shaft passageway between a front blocking end of the tubular body portion and a pair of bushing stops extending into the spike slide passageway portion, and a shock absorbing spring connecting the spike bushing and the end of the elongated retraction shaft; the elongated connecting shaft being sufficiently withdrawable from the connecting shaft passageway to allow the position locking pin to exit the locking pin shaft and sufficiently rotatable to allow the locking pin to rotate out of alignment with the locking pin shaft and contact a top edge of the tubular body portion and hold the pointed spike in a withdrawn position within the spike passageway of the diode cover and protector tip; the shock absorbing spring absorbing impacts between hard items and the pointed end of the rigid pointed spike to minimize damage thereto.

BACKGROUND ART

It is often desirable to retrieve litter items from the ground with a retrieving device to eliminate the need for bending over to lift the litter items. It would be a benefit, therefore, to have a litter retrieving device that included a spike that could be used to pierce the item to be lifted. Because spikes can be dangerous if exposed all the time, it would be a further benefit to have a litter retrieving device that included a retractable spike. In addition, because litter pickup is often best accomplished in the early morning hours before the heat of the day makes working outside undesirable, it would be a further benefit to have a litter retrieval device that included an illumination mechanism to provide illumination to the pointed tip area of the spike to allow the user to positively identify the litter item before it is pierced with the spike.

GENERAL SUMMARY DISCUSSION OF INVENTION

It is thus an object of the invention to provide a litter retrieval device that includes a tubular body portion defining a connecting shaft passageway along the length thereof; a clear, resilient, diode cover and protector tip with a litter spike passageway formed entirely therethrough and into connection with a connecting shaft passageway; two high intensity output diodes encased within the diode cover and protector tip; an on/off switch in series electrical connection between a battery connector positioned within the tubular body portion and the two high intensity diodes; and a litter spike assembly having a handle attached to an elongated retraction shaft having a position locking pin extending radially therefrom that is slidably mounted in a locking pin shaft that is oriented in parallel with the connecting shaft passageway, and that is open at a handle end of the tubular body portion, a spike assembly including a rigid pointed spike having a pointed end slidably positionable within the spike passageway of the diode cover and protector tip and attached at a second spike end to a spike bushing slidably mounted within a spike slide passageway portion of the connecting shaft passageway between a front blocking end of the tubular body portion and a pair of bushing stops extending into the spike slide passageway portion, and a shock absorbing spring connecting the spike bushing and the end of the elongated retraction shaft; the elongated connecting shaft being sufficiently withdrawable from the connecting shaft passageway to allow the position locking pin to exit the locking pin shaft and sufficiently rotatable to allow the locking pin to rotate out of alignment with the locking pin shaft and contact a top edge of the tubular body portion and hold the pointed spike in a withdrawn position within the spike passageway of the diode cover and protector tip; the shock absorbing spring absorbing impacts between hard items and the pointed end of the rigid pointed spike to minimize damage thereto.

Accordingly, a litter retrieval device is provided. The litter retrieval device includes a tubular body portion defining a connecting shaft passageway along the length thereof; a clear, resilient, diode cover and protector tip with a litter spike passageway formed entirely therethrough and into connection with a connecting shaft passageway; two high intensity output diodes encased within the diode cover and protector tip; an on/off switch in series electrical connection between a battery connector positioned within the tubular body portion and the two high intensity diodes; and a litter spike assembly having a handle attached to an elongated retraction shaft having a position locking pin extending radially therefrom that is slidably mounted in a locking pin shaft that is oriented in parallel with the connecting shaft passageway, and that is open at a handle end of the tubular body portion, a spike assembly including a rigid pointed spike having a pointed end slidably positionable within the spike passageway of the diode cover and protector tip and attached at a second spike end to a spike bushing slidably mounted within a spike slide passageway portion of the connecting shaft passageway between a front blocking end of the tubular body portion and a pair of bushing stops extending into the spike slide passageway portion, and a shock absorbing spring connecting the spike bushing and the end of the elongated retraction shaft; the elongated connecting shaft being sufficiently withdrawable from the connecting shaft passageway to allow the position locking pin to exit the locking pin shaft and sufficiently rotatable to allow the locking pin to rotate out of alignment with the locking pin shaft and contact a top edge of the tubular body portion and hold the pointed spike in a withdrawn position within the spike passageway of the diode cover and protector tip; the shock absorbing spring absorbing impacts between hard items and the pointed end of the rigid pointed spike to minimize damage thereto.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

Figure 1:
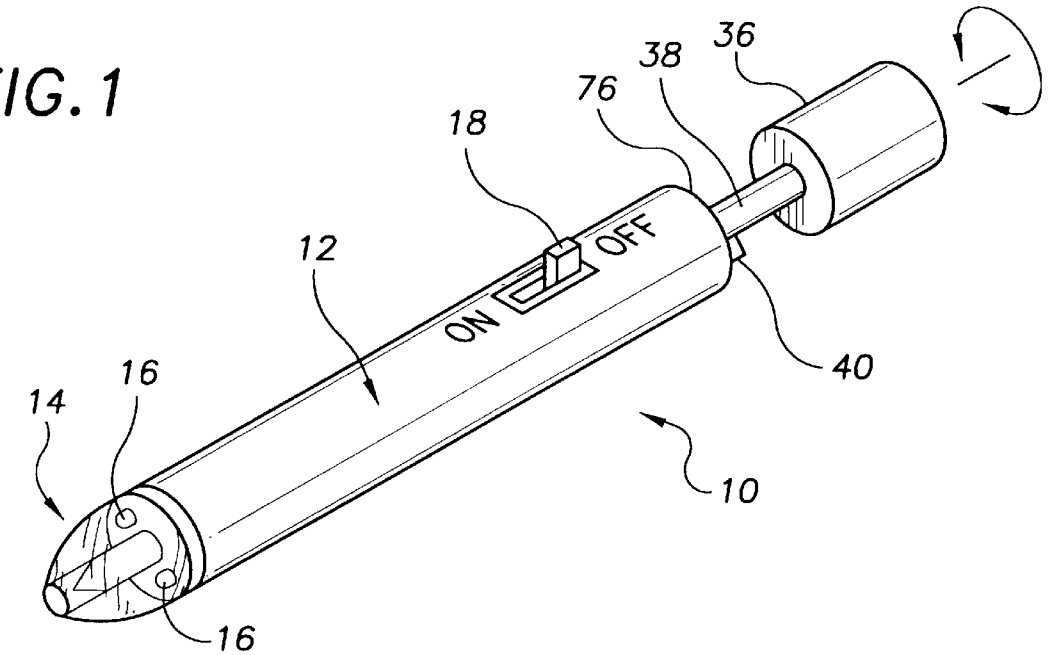
FIG. 1 is a perspective view of an exemplary embodiment of the litter retrieval device of the present invention including the tubular body portion defining a connecting shaft passageway along the length thereof; the clear, resilient, diode cover and protector tip with the litter spike passageway formed entirely therethrough and into connection with the connecting shaft passageway; two high intensity output diodes encased within the diode cover and protector tip; an on/off switch in series electrical connection between a battery connector positioned within the tubular body portion and the two high intensity diodes; and a litter spike assembly having a handle attached to an elongated retraction shaft having a position locking pin extending radially therefrom that is slidably mounted in a locking pin shaft oriented in parallel with the connecting shaft passageway, the locking pin shaft being open at the handle end of the tubular body portion, a spike assembly including a pointed spike having a pointed end slidably positionable within the spike passageway of the diode cover and protector tip and attached at a second spike end to a spike bushing slidably mounted within a spike slide passageway portion of the connecting shaft passageway between a front blocking end of the tubular body portion and a pair of bushing stops extending into the spike slide passageway portion, and a shock absorbing spring connecting the spike bushing and the end of the elongated retraction shaft; the elongated connecting shaft being sufficiently withdrawable from the connecting shaft passageway to allow the position locking pin to exit the locking pin shaft and sufficiently rotatable to allow the locking pin to rotate out of alignment with the locking pin shaft and contact a top edge of the tubular body portion and hold the pointed spike in a withdrawn position within the spike passageway of the diode cover and protector tip.

FIG. 1 shows an exemplary embodiment of the litter retrieval device of the present invention generally designated 10. Litter retrieval device 10 includes a tubular body portion, generally designated 12; a clear, resilient, diode cover and protector tip, generally designated 14; two high intensity output diodes 16; an on/off switch 18; a battery connector 20 (FIG. 2); and a litter spike assembly, generally designated 22.

Figure 2:
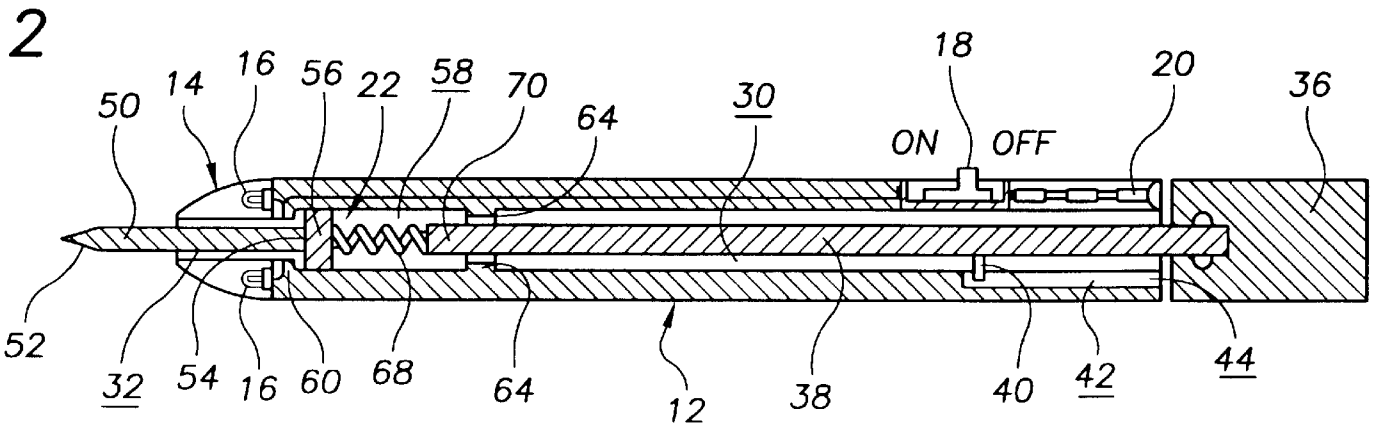
FIG. 2 is a cross sectional view of the exemplary litter retrieval device of FIG. 1 showing the tubular body portion defining the connecting shaft passageway along the length thereof; the clear, resilient, diode cover and protector tip with the litter spike passageway formed entirely therethrough and into connection with the connecting shaft passageway; the two high intensity output diodes encased within the diode cover and protector tip; the on/off switch in series electrical connection between the battery connector positioned within the tubular body portion and the two high intensity diodes; and the litter spike assembly with the handle attached to the elongated retraction shaft and the position locking pin extending radially therefrom that is slidably mounted in the locking pin shaft oriented in parallel with the connecting shaft passageway, the locking pin shaft being open at the handle end of the tubular body portion, the spike assembly including the pointed spike with the pointed end slidably positionable within the spike passageway of the diode cover and protector tip and attached at the second spike end to a spike bushing slidably mounted within the spike slide passageway portion of the connecting shaft passageway between a front blocking end of the tubular body portion and the pair of bushing stops that extend into the spike slide passageway portion, and the shock absorbing spring that connects the spike bushing and the end of the elongated retraction shaft.

Referring to FIG. 2, tubular body portion 12 is constructed of aluminum and defines a connecting shaft passageway 30 along the length thereof. Clear, resilient, diode cover and protector tip 14 is of molded resilient acrylic and has a litter spike passageway 32 formed entirely therethrough and into connection with connecting shaft passageway 30. The two high intensity output diodes 16 each have the light emitting ends thereof encased within diode cover and protector tip 14 and are wired in series with on/off switch 18 and battery connector 20. Litter spike assembly 22 has a handle 36 attached to an elongated retraction shaft 38 positioned through connecting shaft passageway 30 and has a position locking pin 40 extending radially therefrom that is slidably mounted in a locking pin shaft 42 that is oriented in parallel with connecting shaft passageway 30. Locking pin shaft 42 is open at the handle end 44 of tubular body portion 12. A spike assembly 22 is attached to elongated retraction shaft 38 and includes a pointed metal spike 50 having a pointed end 52 slidably positionable within spike passageway 32 of diode cover and protector tip 14 and a second spike end 54 attached to a spike bushing 56 slidably mounted within a spike slide passageway portion 58 of the connecting shaft passageway 30 between a front blocking end 60 of tubular body portion 12 and a pair of bushing stops 64 extending into spike slide passageway portion 58. A shock absorbing spring 68 is connected between the spike bushing 56 and the end 70 of elongated retraction shaft 38. Elongated retraction shaft 38 is sufficiently withdrawable from the connecting shaft passageway 30 to allow the position locking pin 40 (FIG. 1) to exit the locking pin shaft 42 and sufficiently rotatable to allow the locking pin 40 to rotate out of alignment with locking pin shaft 42 and contact a top edge 76 (FIG. 1) of tubular body portion 12 and hold pointed spike 50 in a withdrawn position within spike passageway 32.

It can be seen from the preceding description that a litter retrieval device has been provided that includes a tubular body portion defining a connecting shaft passageway along the length thereof; a clear, resilient, diode cover and protector tip with a litter spike passageway formed entirely therethrough and into connection with a connecting shaft passageway; two high intensity output diodes encased within the diode cover and protector tip; an on/off switch in series electrical connection between a battery connector positioned within the tubular body portion and the two high intensity diodes; and a litter spike assembly having a handle attached to an elongated retraction shaft having a position locking pin extending radially therefrom that is slidably mounted in a locking pin shaft that is oriented in parallel with the connecting shaft passageway, and that is open at a handle end of the tubular body portion, a spike assembly including a rigid pointed spike having a pointed end slidably positionable within the spike passageway of the diode cover and protector tip and attached at a second spike end to a spike bushing slidably mounted within a spike slide passageway portion of the connecting shaft passageway between a front blocking end of the tubular body portion and a pair of bushing stops extending into the spike slide passageway portion, and a shock absorbing spring connecting the spike bushing and the end of the elongated retraction shaft; the elongated connecting shaft being sufficiently withdrawable from the connecting shaft passageway to allow the position locking pin to exit the locking pin shaft and sufficiently rotatable to allow the locking pin to rotate out of alignment with the locking pin shaft and contact a top edge of the tubular body portion and hold the pointed spike in a withdrawn position within the spike passageway of the diode cover and protector tip; the shock absorbing spring absorbing impacts between hard items and the pointed end of the rigid pointed spike to minimize damage thereto.

It is noted that the embodiment of the litter retrieval device described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A litter retrieval device comprising:

a tubular body portion defining a connecting shaft passageway along the length thereof;

a clear, resilient, diode cover and protector tip with a litter spike passageway formed entirely therethrough and into connection with a connecting shaft passageway;

a high intensity output diode encased within the diode cover and protector tip;

an on/off switch in series electrical connection between a battery connector positioned within the tubular body portion and the high intensity diode; and a litter spike assembly having a handle attached to an elongated retraction shaft having a position locking pin extending radially therefrom that is slidably mounted in a locking pin shaft that is oriented in parallel with the connecting shaft passageway, and that is open at a handle end of the tubular body portion, a spike assembly including a rigid pointed spike having a pointed end slidably positionable within the spike passageway of the diode cover and protector tip and attached at a second spike end to a spike bushing slidably mounted within a spike slide passageway portion of the connecting shaft passageway between a front blocking end of the tubular body portion and a pair of bushing stops extending into the spike slide passageway portion, and a shock absorbing spring connecting the spike bushing and the end of the elongated retraction shaft;

the elongated retraction shaft being sufficiently withdrawable from the connecting shaft passageway to allow the position locking pin to exit the locking pin shaft and sufficiently rotatable to allow the locking pin to rotate out of alignment with the locking pin shaft and contact a top edge of the tubular body portion and hold the pointed spike in a withdrawn position within the spike passageway of the diode cover and protector tip;

the shock absorbing spring absorbing impacts between hard items and the pointed end of the rigid pointed spike to minimize damage thereto.

* * * * *